US012290115B2

(12) United States Patent
Meggitt et al.

(10) Patent No.: US 12,290,115 B2
(45) Date of Patent: May 6, 2025

(54) GARMENTS

(71) Applicant: Coolside Limited, Glasgow (GB)

(72) Inventors: Ryder Magnus Iain Meggitt, Dunfermline (GB); Jonathan Ian Campbell, Glasgow (GB); Eilidh Alexandra Earle-Mitchell, Glasgow (GB)

(73) Assignee: Coolside Limited, Glasgow (GB)

( * ) Notice: Subject to any disclaimer, the term of this patent is extended or adjusted under 35 U.S.C. 154(b) by 15 days.

(21) Appl. No.: 18/020,726

(22) PCT Filed: Aug. 10, 2021

(86) PCT No.: PCT/GB2021/052060
§ 371 (c)(1),
(2) Date: Feb. 10, 2023

(87) PCT Pub. No.: WO2022/034304
PCT Pub. Date: Feb. 17, 2022

(65) Prior Publication Data

US 2023/0329370 A1 Oct. 19, 2023

(30) Foreign Application Priority Data

Aug. 10, 2020 (GB) ..... 2012437

(51) Int. Cl.
*A41D 13/11* (2006.01)
*A41D 23/00* (2006.01)

(52) U.S. Cl.
CPC ..... *A41D 13/1161* (2013.01); *A41D 23/00* (2013.01)

(58) Field of Classification Search
CPC ..... A42B 3/20; A41D 13/1161; A41D 23/00
See application file for complete search history.

(56) References Cited

U.S. PATENT DOCUMENTS 4,494,246 A * 1/1985 Tillbrook ..... A41D 13/012 2/24
5,058,211 A 10/1991 Hanks
(Continued)

FOREIGN PATENT DOCUMENTS

| | | |
|---|---|---|
| AU | 2008100008 | 2/2008 |
| GB | 2012437.6 | 1/2021 |
| WO | 2022034304 | 2/2022 |

OTHER PUBLICATIONS

"How to Make a DIY No-Sew Face Mask" Good Housekeeping via YouTube, published Apr. 10, 2020.
(Continued)

*Primary Examiner* — Tajash D Patel
(74) *Attorney, Agent, or Firm* — Dorton & Willis LLP; Ryan Willis

(57) ABSTRACT

A garment (1) comprising a sheet of fabric material (2) and a wearer attachment device (4) is illustrated and described. The wearer attachment device is configured to allow the garment to be attached to the neck or head of the wearer. The garment comprises one or more releasable fastening devices (6*a*, 6*b*, 6*c*). The sheet of fabric is configurable between a first unfolded position and a second folded position. In the second folded position the sheet of fabric is folded into the shape of a face mask that, in use, allows the garment to cover at least a portion of the wearer's mouth and nose. The sheet of fabric is held in the second folded position by the one or more releasable fastening devices.

28 Claims, 7 Drawing Sheets

(56) References Cited

U.S. PATENT DOCUMENTS

| | | | | |
|---|---|---|---|---|
| 9,402,428 | B2 * | 8/2016 | Miers | A41D 13/1146 |
| 11,766,079 | B2 * | 9/2023 | Snoke | A41D 13/1161 2/206 |
| 2011/0209710 | A1 | 9/2011 | Spencer, III | |
| 2016/0213959 | A1 | 7/2016 | Barklow | |
| 2016/0316831 | A1 | 11/2016 | Yarahmadi | |
| 2017/0119076 | A1 * | 5/2017 | Marji | A42B 1/048 |
| 2021/0346728 | A1 * | 11/2021 | Fischer | A41D 13/1115 |
| 2021/0352978 | A1 * | 11/2021 | Cavero | A62B 23/025 |
| 2022/0071323 | A1 * | 3/2022 | Rudy | A41D 13/1138 |
| 2022/0087335 | A1 * | 3/2022 | Lorenz | A41D 27/18 |
| 2023/0363474 | A1 * | 11/2023 | DeCarlo | A41D 13/11 |
| 2024/0042252 | A1 * | 2/2024 | Hoffman | B32B 3/08 |

OTHER PUBLICATIONS

"Folding a bandana into fade mask" Douglas Graham via YouTube, published Apr. 6, 2020.

* cited by examiner

GARMENTS

This application is a national stage of PCT/GB2021/052060, filed Aug. 10, 2021, which claimed priority to Great Britain patent application number 2012437.6, filed Aug. 10, 2020, all of which are incorporated by reference.

FIELD OF THE INVENTION

The present invention relates to a garment, particularly, but not exclusively, a neck garment that may be reconfigured as a face mask.

BACKGROUND TO THE INVENTION

Virus protection face masks are known. Such known face masks may be worn by a wearer to protect themselves from airborne viruses and/or to protect others from being infected by a virus that the wearer has.

While such known face masks are capable of providing sufficient levels of virus protection, the use of these masks is not without problems. For example, a wearer must frequently put the mask on their face and take the mask off again during their activities. This process can be time consuming and frustrating, as known face mask are often difficult to hook around a wearer's ears. It is also possible for the face mask to be misplaced or lost during this process. Furthermore, repeated putting on and taking off of the face mask increase the risk of virus spread, as the face mask may be accidentally dropped in an area, which is then required to be disinfected. Known face masks are also not aesthetically pleasing to some wearers, which may prevent usage of the mask, which is a concern for virus control.

The inventors have appreciated the shortcomings in known virus control face masks.

According to a first aspect of the present invention there is provided a garment comprising:

a sheet of fabric material;

a wearer attachment device, the wearer attachment device being configured to allow the garment to be attached to the neck or head of the wearer; and one or more releasable fastening devices, wherein the sheet of fabric is configurable between a first unfolded position and a second folded position, wherein in the second folded position the sheet of fabric is folded into the shape of a face mask that, in use, allows the garment to cover at least a portion of the wearer's mouth and nose, and wherein the sheet of fabric is held in the second folded position by the one or more releasable fastening devices.

The term garment includes any wearable item, such as an item of clothing, scarf, bandana, headgear, headwear, neck garment, neckwear, neckgear, and face covering. The term fabric includes any material from which garments can be made, including plastics, synthetic materials, natural materials, and any other suitable material.

The garment may comprise a bandana element. The garment may be a bandana. The garment may be a bandana mask. The garment may comprise a scarf element. The garment may be a scarf. The garment may comprise a headwear, or headgear, element. The garment may comprise a neckwear, or neckgear, element.

The garment may be configured as a face shield, or face covering, when in the second folded position. The garment may be configurable as a protective covering, personal protective equipment (PPE), or the like, when in the second folded position.

The garment may be configurable to be worn at least partially around, or on, the neck and/or head of the wearer. The garment may be configurable to be worn around, or on, the upper body, or upper portion of the torso of the wearer.

The garment may be a substantially planar member. The garment may be a substantially planar member when the sheet of fabric is in the first unfolded position. The sheet of fabric may be a planar member. The sheet of fabric may be a planar member when the sheet is in the first unfolded position.

In the second folded position the garment may be arranged to cover at least a lower portion of the wearer's face, at least a portion of the lower half of the wearer's face, the majority of the wearer's face, and/or at least an upper portion of the user's face.

In the second folded position, the garment may be arranged to cover at least a portion of the wearer's nose, at least a portion of the bridge of the wearer's nose, at least a portion of the wearer's cheekbones, at least a portion of the wearer's cheeks, at least a portion of the wearer's jaws, at least a portion of the underside of the wearer's jaws, at least a portion of the wearer's chin, at least a portion of the underside of the wearer's chin, and/or at least a portion of the wearer's neck.

In the second folded position, the garment may be arranged to be in contact with at least a portion of the wearer's nose, at least a portion of the bridge of the wearer's nose, at least a portion of the wearer's cheekbones, at least a portion of the wearer's cheeks, at least a portion of the wearer's jaws, at least a portion of the underside of the wearer's jaws, at least a portion of the wearer's chin, at least a portion of the underside of the wearer's chin, and/or at least a portion of the wearer's neck.

The garment may be configured to be sealable to at least a part of the wearer's face. The garment may be configured to be reversibly sealable to at least a part of the wearer's face. In this arrangement, the garment can be sealed to at least a part of the wearer's face by the wearer configuring the sheet of fabric from the first unfolded position to the second folded position, and can be unsealed by configuring the garment back to the first unfolded position.

The garment may be configured to be reversibly sealable to at least a part of the wearer's face by the wearer configuring the sheet of fabric from the first unfolded position to the second folded position to seal the garment, and unsealing the garment by configuring the garment from the second folded position back to the first unfolded position.

In the second position, the garment may be configured to form a seal around the wearer's nose and mouth. In the second folded position, the garment may be arranged to form a seal around at least a portion of the wearer's nose, at least a portion of the bridge of the wearer's nose, at least a portion of the wearer's cheekbones, at least a portion of the wearer's cheeks, at least a portion of the wearer's jaw, at least a portion of the underside of the wearer's jaw, at least a portion of the wearer's chin, at least a portion of the underside of the wearer's chin, and/or at least a portion of the wearer's neck. The seal may form an at least partial vacuum seal. The seal may be a substantially airtight seal.

In the second folded position, at least a portion of the garment may be shaped to match the contour(s) of at least a portion of the wearer's nose, at least a portion of the bridge of the wearer's nose, at least a portion of the wearer's cheekbones, at least a portion of the wearer's cheeks, at least a portion of the wearer's jaw, at least a portion of the underside of the wearer's jaw, at least a portion of the wearer's chin, at least a portion of the underside of the wearer's chin, and/or at least a portion of the wearer's neck.

In the second folded position, at least a portion of the garment may be shaped to match at least a portion of the shape of the wearer's nose, at least a portion of the shape of the bridge of the wearer's nose, at least a portion of the shape of the wearer's cheekbones, at least a portion of the shape of the wearer's cheeks, at least a portion of the shape of the wearer's jaw, at least a portion of the shape of the underside of the wearer's jaw, at least a portion of the shape of the wearer's chin, at least a portion of the shape of the underside of the wearer's chin, and/or at least a portion of the shape of the wearer's neck.

In the second folded position, at least a portion of the garment may be arranged to match at least a portion of the curvature of the wearer's face. In the second folded position, at least a portion of the garment may be arranged to match at least a portion of the curvature of the wearer's nose, at least a portion of the shape of the bridge of the wearer's nose, at least a portion of the shape of the wearer's cheekbones, at least a portion of the shape of the wearer's cheeks, at least a portion of the shape of the wearer's jaws, at least a portion of the shape of the underside of the wearer's jaws, at least a portion of the shape of the wearer's chin, at least a portion of the shape of the underside of the wearer's chin, and/or at least a portion of the shape of the wearer's neck.

In the second folded position the garment may comprise one or more contact points configurable to be in contact with at least a portion of the wearer's face. One or more of the contact points may define a continuous contact area between at least a portion of the garment and the wearer's face. The contact area may include at least a portion of the wearer's nose, at least a portion of the bridge of the wearer's nose, at least a portion of the wearer's cheekbones, at least a portion of the wearer's cheeks, at least a portion of the wearer's jaws, at least a portion of the underside of the wearer's jaws, at least a portion of the wearer's chin, at least a portion of the underside of the wearer's chin, and/or at least a portion of the wearer's neck.

In the second folded position, the contact area between the garment and the wearer's face may form at least one continuous, substantially uninterrupted contact area between the garment and the wearer's face. In this arrangement, there are no gaps in the contact area between the garment and the wearer.

In the second folded position, the contact area between the garment and the wearer's face may define a substantially circular, elliptical, or oval shape.

The second folded position may be a mask mode, or face mask mode. In the second folded position the sheet is folded into the shape of, or substantially resembles the shape of any suitable face mask, such as a surgical face mask, N95 face mask, dust mask, or the like.

The sheet of fabric may comprise a horizontal axis and a vertical axis. The horizontal axis is arranged to be horizontal, and the vertical axis is arranged to be vertical, when the garment is in use by the wearer standing vertically, or when the wearer's head is otherwise orientated vertically. The sheet of fabric may comprise one or more upper edges, one or more lower edges, one or more left side edges and one or more right side edges. The upper edge(s) may be arranged at an opposite end of the sheet to the lower edge(s). The left side edges may be located at opposite ends of the sheet to the right side edges. The upper edge(s) may be spaced apart from the lower edge(s) along the vertical axis, and the left side edge(s) may be spaced apart from the right side edge(s) along the horizontal axis. Each side edge may include an upper side edge located adjacent to an upper edge of the sheet, a lower side edge located adjacent to a lower edge of the sheet, and/or a mid side edge located between the upper side edge and the lower side edge. The sheet may include an upper portion located adjacent to an upper edge, a lower portion located adjacent to a lower edge, and a mid portion located between the lower portion and the upper portion. The mid portion may include an upper mid portion located adjacent to the upper portion of the sheet, and a lower mid portion located adjacent to the lower portion of the sheet.

The garment may comprise a filter element receiving portion configured to receive one or more filter elements. The garment may comprise one or more filter elements configured to filter one or more hazardous substances from air to be inhaled by the wearer and/or air to be exhaled by the wearer. The filter element(s) may be disposable filter element(s). The garment may comprise a plurality of filter element receiving portions, each filter element receiving portion being configured to receive at least one filter element. The sheet of fabric may include the filter element receiving portion of the garment. The sheet of fabric may include at least one filter element. The filter element receiving portion may include a pocket, pouch, receptacle, or the like, for receiving the filter element. The filter element receiving portion may include an access point for adding or removing the filter element to or from the filter element receiving portion. The access point may be a slot, opening, hole, orifice, slit, or the like. The access point may be reversibly securable.

The garment may comprise one or more filter elements configured to filter one or more hazardous substances from air to be inhaled by the wearer and/or air to be exhaled by the wearer and/or the garment may comprise the filter element receiving portion configured to receive one or more filter elements.

The filter element receiving portion and/or the filter element may be located at an upper portion of the sheet of fabric. The filter element receiving portion and/or the filter element may be located at an upper mid portion of the sheet of fabric. The filter element receiving portion and/or the filter element may be located at a portion of the sheet that, in use, is at or near to the mouth and/or nose of the wearer when the sheet of fabric is in the second folded position. The filter element receiving portion may define a substantially rectangular, or square, section for receiving the filter element therein. The filter element receiving portion and/or the filter element may be spaced apart from an upper edge, a lower edge, a side edge, an upper side edge, a mid side edge, a lower side edge, a left side edge, and/or a right side edge of the sheet of fabric. The filter element receiving portion may be located at an inner surface of the sheet of fabric.

The filter element receiving portion may be substantially planar.

The filter element may be a substantially rectangular, or square, shaped filter element. The filter element may be shaped to correspond to the shape of the filter element receiving portion. The filter element may comprise one or more filter layers. The filter element may comprise five filter layers. The filter element may be configured to filter approximately 95% or more of particulate matter and/or hazardous material from the air to be inhaled/exhaled by the wearer.

The garment may be configurable to filter at least a portion of the air to be inhaled and/or exhaled by the wearer when the sheet is in the first unfolded position and/or when the sheet is in the second folded position. The garment may be configurable to filter a higher percentage of the air to be inhaled and/or exhaled by the wearer when the sheet is in the second folded position than in the first unfolded position.

The sheet may comprise one or more predetermined fold lines configured to determine, at least in part, how the sheet of fabric is foldable from the first unfolded position to the second folded position. The one or more fold lines may define, at least in part, where the sheet of fabric should be folded to configure the sheet of fabric between the first unfolded position and the second folded position.

In the second folded position, at least a portion of the garment may be spaced apart from the wearer's mouth and/or nose. In the second folded position, at least a portion of the sheet of fabric may be spaced apart from the wearer's mouth and/or nose. In this arrangement, at least one cavity is formed between the sheet of fabric and the wearer's face, which makes the garment more comfortable to wear in the second folded position. At least a portion of the filter element receiving portion and/or the filter element may be located at a portion of the sheet that is arranged to be spaced apart from the wearer's mouth and/or nose when the sheet is in the second folded position. In this arrangement, at least a portion of the filter element is spaced apart from the wearer's face when the garment is in use and the sheet is in the second folded position.

The garment may be configurable to project at least a portion of the sheet of fabric away from the wearer's mouth and/or nose. The one or more fold lines of the garment may be configured to project at least a portion of the sheet of fabric away from the wearer's mouth and/or nose. In this arrangement, at least a portion of the sheet of fabric is spaced from the wearer's mouth and/or nose.

In the second folded position, the fold lines may form frame members of a frame. The frame members formed by the fold lines may provide support to the garment in the second folded position. The frame members may be ribs, bars, rigid members, creases, or the like. In this arrangement, when the sheet of fabric is folded along the fold lines, the frame formed by the fold lines assists in holding, or maintaining, the sheet of fabric in the second folded position, which helps to maintain the cavity between the sheet of fabric and the wearer's face.

The, or each, fold line may be one or more at least partially stitched portions of the sheet. The, or each, fold line may be located at an inner side of the sheet of fabric and/or at an outer side of the sheet of fabric.

One or more of the fold line(s) may be arranged from a left upper side edge of the sheet to an upper mid portion of the sheet. The direction of the fold line(s) may be along the horizontal axis of the sheet. The direction of the fold line(s) may be along the horizontal axis of the sheet and angularly offset therefrom. The direction of the fold line(s) may be diagonally along the horizontal axis of the sheet. The direction of the fold line(s) may be diagonally down from the left side edge of the sheet to an upper mid portion of the sheet along the horizontal axis. The fold line(s) may be substantially linear. The fold line(s) may run from the left upper side edge of the sheet to a left side edge portion of the filter receiving portion.

One or more of the fold line(s) may be arranged from a right upper side edge of the sheet to an upper mid portion of the sheet. The direction of the fold line(s) may be along the horizontal axis of the sheet. The direction of the fold line(s) may be along the horizontal axis of the sheet and angularly offset therefrom. The direction of the fold line(s) may be diagonally along the horizontal axis of the sheet. The direction of the fold line(s) may be diagonally down from the right side edge of the sheet to an upper mid portion of the sheet along the horizontal axis. The fold line(s) may be substantially linear. The fold line(s) may run from the right upper side edge of the sheet to a right side edge portion of the filter receiving portion.

One or more of the fold line(s) may be arranged from a left mid side edge of the sheet to an upper mid portion of the sheet. The direction of the fold line(s) may be along the horizontal axis of the sheet. The direction of the fold line(s) may be along the horizontal axis of the sheet and angularly offset therefrom. The direction of the fold line(s) may be diagonally along the horizontal axis of the sheet. The direction of the fold line(s) may be diagonally up from the left side edge of the sheet to an upper mid portion of the sheet(s) along the horizontal axis. The fold line(s) may be substantially linear. The fold line(s) may run from the left mid side edge of the sheet to a left side edge portion of the filter receiving portion. The fold line(s) may run from the left mid side edge of the sheet to a lower corner portion of the filter receiving portion.

One or more of the fold line(s) may be arranged from a right mid side edge of the sheet to an upper mid portion of the sheet. The direction of the fold line(s) may be along the horizontal axis of the sheet. The direction of the fold line(s) may be along the horizontal axis of the sheet and angularly offset therefrom. The direction of the fold line(s) may be diagonally along the horizontal axis of the sheet. The direction of the fold line(s) may be diagonally up from the right side edge of the sheet to an upper mid portion of the sheet along the horizontal axis. The fold line(s) may be substantially linear. The fold line(s) may run from the right mid side edge of the sheet to a right side edge portion of the filter receiving portion. The fold line(s) may run from the right mid side edge of the sheet to a lower corner portion of the filter receiving portion.

One or more of the fold line(s) may be arranged from a left lower side edge of the sheet to a right lower side edge of the sheet. The direction of the fold line(s) may be along the horizontal axis of the sheet. The direction of the fold line(s) may be parallel to the horizontal axis of the sheet. The fold line(s) may be substantially linear. At least a part of the fold line(s) may be arranged to be parallel to a lower side edge of the filter receiving portion.

At least one set of fold lines may be convergent. At least two sets of fold lines may be convergent. The, or each, set of fold lines may be arranged to converge from the, or each, side edge of the sheet towards the centre of the sheet in the direction of the horizontal axis, or angularly offset from the horizontal axis. The, or each, set of fold lines may be arranged to converge from a side edge of the sheet towards the filter element receiving portion.

The filter element receiving portion may be located adjacent to one or more of the fold line(s).

The garment may comprise a plurality of sheets of fabric material. The sheet of fabric is a flexible sheet.

The sheet is configured to permit air to flow through at least a portion thereof. The sheet may be configured to permit air to flow from the outer side thereof to the inner side thereof through at least a portion of the sheet, the outer side facing the surrounding environment and the inner side facing the wearer.

The sheet may be configured to prevent air from flowing through at least a portion thereof. The sheet may be configured to permit air to flow through one or more portions thereof and to prevent air from flowing through one or more portions thereof.

The sheet may be configured to permit air to flow from the outer surface thereof through the filter receiving portion to the inner surface of the sheet.

The sheet may be configured to permit air to flow from the outer side thereof through the filter receiving portion to the inner side of the sheet and to prevent air from flowing through the other portion(s) of the sheet.

The sheet may comprise one or more porous sections configured to permit air to flow therethrough. The sheet may comprise one or more non-porous sections configured to prevent air from flowing therethrough. At least a portion of the, or each, porous section may be arranged to overlay at least a portion of the filter element receiving portion and/or the filter element.

The sheet of fabric may comprise one or more fabric layers. The sheet of fabric may comprise a first layer and a second layer.

The first layer may include the outer side of the sheet. The second layer may include the inner side of the sheet.

The first layer may include one or more of the porous section(s) of the sheet. The second layer may include one or more of the porous section(s) of the sheet. Substantially all of the first layer may be porous. Substantially all of the second layer may be porous.

The sheet of fabric may further comprise a third layer. The first layer may be located adjacent to the third layer. The third layer may be located adjacent to the second layer. The third layer may be located between the first and second layers. The first layer may be connected to the third layer and the third layer may be connected to the second layer.

The first layer, second layer and/or third layer of the sheet of fabric may include at least a portion of the filter element receiving portion.

The third layer may include one or more of the non-porous section(s) of the sheet of fabric. The third layer may include one or more of the porous section(s) of the sheet of fabric. The porous section of the third layer may include one or more holes, or optionally a single hole. The porous section of the third layer may be located at a mid portion of the sheet, or an upper mid portion of the sheet.

The porous section(s) of the third layer may be arranged to at least partially overlay the filter element receiving portion and/or the filter element. The non-porous section(s) of the third layer may be arranged to prevent air from flowing from the porous section(s) of the first layer to the porous section(s) of the second layer without passing through the filter element receiving portion.

The sheet may comprise one or more air-permeable materials, breathable materials, a plastics material, polymer materials, polyester and/or machine washable material. The garment may be configured to be machine washable. The garment may be configured to be compatible with one or more antimicrobial or antibacterial processes.

The first layer may be made from an air-permeable material, a breathable material, cotton, a plastics material, a polymer material, polyester, and/or a machine washable material.

The second layer may be made from an air-permeable material, a breathable material, cotton, a plastics material, a polymer material, polyester and/or a machine washable material.

The third layer may be made from a woven material, a woven material coated with polyurethane, plastics material, a polymer material, a machine washable material, an air-impermeable material, and/or any other suitable non-porous material. The third layer may comprise polyurethane.

The first layer, second layer and/or third layers may be planar layers. The first layer, second layer and third layer may be congruent.

The sheet may comprise one or more antibacterial agents or antimicrobial agents. The first layer and/or second layer may comprise the one or more antibacterial or antimicrobial agents. The outer side and/or inner side of the sheet may comprise the one or more antibacterial or antimicrobial agents.

The releasable fastening device(s) of the garment may include one or more magnets, press studs, snap fit connectors, hook and loop fasteners, hooks, buttons, buckles, hooks, and/or any other suitable releasable fastening device capable of fastening one portion of the sheet to another portion of the sheet.

One or more of the releasable fastening device(s) of the garment may be located on the inner surface of the sheet. One or more of the releasable fastening device(s) of the garment may be located on the outer surface of the sheet. One or more of the releasable fastening device(s) of the garment may be located on the inner surface of the sheet and/or on the outer surface of the sheet. One or more of the releasable fastening device(s) may be located at least partially within the sheet. One or more of the releasable fastening devices may be covered by the sheet.

The, or each, releasable fasting device of the garment may include one or more connection members. One or more, or all, of the releasable fastening device(s) of the garment may be an adjustable releasable fastening device. The releasable fastening device of the garment may be configured to allow at least some of the connection members to be connected at different positions relative to one another. The connection members may be one or more magnets, press studs, snap fit connectors, hook and loop fasteners, hooks, buttons, buckles, hooks, and/or any other suitable releasable fastening device capable of fastening one portion of the sheet to another portion of the sheet, and the connection members may be connectable to each other at one or more contact points, optionally two or more contact points, optionally three or more contact points.

At least one connection member of the releasable fastening device of the garment may be located at an upper portion of the sheet of fabric and at least one corresponding connection member of the releasable fastening device of the garment may be located at a mid portion of the sheet of fabric.

At least one connection member may be located at a left upper portion of the sheet of fabric and at least one corresponding connection member may be located at a left mid portion of the sheet of fabric. At least one connection member may be located at a right upper portion of the sheet of fabric and at least one corresponding connection member may be located at a right mid portion of the sheet of fabric. At least one connection member may be located at a mid portion of the sheet of fabric and at least one corresponding connection member may be located at a lower portion of the sheet of fabric. At least one connection member may be located at a lower portion of the sheet of fabric and at least one corresponding connection member may be located at a mid point of the sheet of fabric.

The connection members of the releasable fastening device may be spaced apart from the fold lines of the sheet of fabric. The connection members may be spaced apart from the filter receiving portion.

At least one connection member may be located adjacent to a left side edge of the filter receiving portion. At least one connection member may be located adjacent to an upper edge of the sheet. At least one connection member may be located adjacent to a left side edge of the filter receiving portion and located adjacent to an upper edge of the sheet.

At least one connection member may be located adjacent to a right side edge of the filter receiving portion. At least one connection member may be located adjacent to a right side edge of the filter receiving portion and located adjacent to an upper edge of the sheet.

At least one connection member may be located adjacent to a left mid side edge of the sheet of fabric.

At least one connection member may be located adjacent to a right mid side edge of the sheet of fabric.

At least one connection member may be located adjacent to one or more fold lines.

In the first unfolded position the garment may be wearable as a bandana, scarf, face covering, head covering, headwear, neckwear, and/or worn loosely around the wearer. In the first unfolded position the garment may be wearable around the user's neck and/or pulled up around the user's face, optionally around at least a part of the user's nose. In the first unfolded position the garment may be wearable around the user's head, neck, and/or upper torso. In the first unfolded position the garment may be substantially planar. In the first unfolded position the garment may be arranged to be worn comfortably when in use. The garment may be configured to be more comfortable, in use, for the wearer when in the first unfolded position than in the second folded position.

The garment may be configured such that at least a portion of the sheet is deformable from a first position to a second position. The garment may be configured such that the at least a portion of the sheet is deformable from the second position to the first position. The at least a portion of the sheet may be configured to remain in the second position until the wearer applies a force thereto. The sheet may comprise one or more malleable sections, the malleable section(s) being deformable from the first position to the second position. The malleable sections may be movable from the second position to the first position. The malleable sections may be configured to remain in the second position until the wearer applies a force thereto.

The at least a portion of the sheet may be deformable when the sheet is in the first unfolded position and/or when the sheet is in the second folded position.

The sheet may comprise one or more metals, malleable portions, malleable metals, and/or flexible metals, which define the malleable section of the sheet. The sheet may comprise a nose clip, flexible wire, or the like, which defines the malleable section of the sheet. The malleable section may be located within the sheet of fabric.

The malleable section may be configurable, in use, to fit around at least a portion of the wearer's nose, or a portion of the bridge of the user's nose.

The malleable section may be located at an upper portion of the sheet. The malleable section may be located at an uppermost portion of the sheet. The malleable section may be located adjacent to an upper edge of the sheet.

The malleable section may be deformable to the shape of at least a portion of the wearer's nose.

The garment may comprise an adjustment device operable to adjust the position of the sheet relative to the wearer's face. The adjustment device may be configured to seal at least a portion of the sheet against the wearer's face. The adjustment device may be configured to seal at least a portion of the sheet against the underside of the wearer's jaw, the underside of the wearer's chin, and/or at least a portion of the wearer's cheeks. The adjustment device may be a cord, a drawcord, a length of adjustable cord, a length of adjustable drawcord, an elasticated cord, a length adjustable elasticated cord, or the like. The adjustment device may be located at a lower portion of the sheet. The sheet may include one or more adjustment device receiving members configured to receive at least a portion of the adjustment device. The adjustment device receiving members may be one or more loop portions, openings, or the like. The adjustment device receiving members may be located at a left lower side edge and/or a right lower side edge of the sheet of fabric. The adjustment device receiving members may be located adjacent to a portion of a fold line.

At least a portion of the adjustment device may be located adjacent to the lower edge of the sheet, at least a portion of the left lower side edge, at least a portion of the right lower side edge and/or the lower portion of the sheet of fabric. At least a portion of the adjustment device may be located adjacent to one or more fold lines of the sheet of fabric. At least a portion of the adjustment device may be arranged adjacent to one or more fold lines of the sheet of fabric, the fold line(s) being arranged from a left lower side edge of the sheet of fabric to a right lower side edge of the sheet of fabric. At least a portion of the adjustment device may be located parallel to one or more fold lines of the sheet of fabric. At least a portion of the adjustment device may be arranged parallel to one or more fold lines of the sheet of fabric, the fold line(s) being arranged from a left lower side edge of the sheet of fabric to a right lower side edge of the sheet of fabric. At least a portion of the adjustment device may be arranged along the horizontal axis of the sheet of fabric, or angularly offset from the horizontal axis.

The sheet of fabric may comprise one or more valve devices operable between a first position, in which air is prevented from flowing from the inner side of the sheet through the valve to the outer side of the sheet and a second position, in which air is permitted to flow from the inner side of the sheet through the valve to the outer side of the sheet.

The valve device may be a one way valve configured to prevent air from flowing from the outer side through the valve to the inner side when in the first position and when in the second position.

The valve device may be operable from the first position to the second position in response to the wearer's exhaled breath. In this example, the wearer's exhaled breath operates the valve device from the first position to the second position.

The valve device may be operable from the second position to the first position in response to the wearer's inhaled breath. In this example, the wearer's inhaled breath closes the valve device.

The valve device may be lockable in the first position.

The valve device may comprise a locking member configured to engage with and lock the valve device in the first position. The locking member may be a lid, a seal, a cover member, a cap, a plug, or the like. The locking member may be configured to form an airtight seal when engaged with and locked to the valve device. The locking member may be configured to form an at least partial vacuum seal when engaged with and locked to the valve device. The locking member may be operable by hand.

The wearer attachment device may comprise one or more connecting members. The connecting members may be straps, loops, hoops, or the like. The wearer attachment device may comprise one or more releasable fastening devices for securing the wearer attachment device to the user. The releasable fastening device(s) of the wearer attachment device may be located on the one or more connecting members of the wearer attachment device. The releasable fastening device(s) may include at least one of: magnets, hook and loop fasteners, buttons, snap fit connectors, buckles, hooks, or the like, or any suitable device for fastening the wearer attachment device.

The wearer attachment device may be adjustable. The releasable fastening device of the wearer attachment device may be an adjustable releasable fastening device. The releasable fastening device of the wearer attachment device may be configured to allow the connecting members to be connected at different positions relative to one another.

The wearer attachment device may be releasably attachable to the sheet of fabric.

The wearer attachment device may comprise a resilient material, such as polychloroprene (Neoprene).

According to a second aspect of the present invention there is provided a method of wearing a garment, the method comprising the steps of:

providing a garment comprising:

a sheet of fabric material;

a wearer attachment device, the wearer attachment device being configured to allow the garment to be attached to the neck or head of the wearer; and one or more releasable fastening devices, wherein the sheet of fabric is configurable between a first unfolded position and a second folded position, wherein in the second folded position the sheet of fabric is folded into the shape of a face mask that, in use, allows the garment to cover at least a portion of the wearer's mouth and nose, and wherein the sheet of fabric is held in the second folded position by the one or more releasable fastening devices, attaching the garment to the wearer using the wearer attachment device; and configuring the sheet of fabric from the first unfolded position to the second folded position using the one or more releasable fastening devices.

The wearer attachment device may be configured to allow the garment to be attached to the head and neck of the wearer. The wearer attachment device may be configured to allow the garment to be attached to the head and/or neck of the wearer.

Embodiments of the second aspect of the present invention may include one or more features of the first aspect of the present invention or its embodiments. Similarly, embodiments of the first aspect of the present invention may include one or more features of the second aspect of the present invention or its embodiments.

According to a third aspect of the present invention there is provided a garment comprising:

a sheet of fabric material;

a wearer attachment device, the wearer attachment device being configured to allow the garment to be attached to the neck and/or head of the wearer; and one or more releasable fastening devices, wherein the sheet of fabric is configurable between a first unfolded position and a second folded position, wherein in the second folded position the sheet of fabric is folded into the shape of a face mask that, in use, allows the garment to cover at least a portion of the wearer's mouth and nose, and wherein the sheet of fabric is held in the second folded position by the one or more releasable fastening devices.

Embodiments of the third aspect of the present invention may include one or more features of the first and/or second aspects of the present invention or its embodiments. Similarly, embodiments of the first and/or second aspects of the present invention may include one or more features of the third aspect of the present invention or its embodiments.

According to a fourth aspect of the present invention there is provided a garment comprising:

a sheet of fabric material;

a wearer attachment device, the wearer attachment device being configured to allow the garment to be attached to the neck and head of the wearer; and one or more releasable fastening devices, wherein the sheet of fabric is configurable between a first unfolded position and a second folded position, wherein in the second folded position the sheet of fabric is folded into the shape of a face mask that, in use, allows the garment to cover at least a portion of the wearer's mouth and nose, and wherein the sheet of fabric is held in the second folded position by the one or more releasable fastening devices.

Embodiments of the fourth aspect of the present invention may include one or more features of the first, second and/or third aspects of the present invention or its embodiments. Similarly, embodiments of the first, second and/or third aspects of the present invention may include one or more features of the fourth aspect of the present invention or its embodiments.

BRIEF DESCRIPTION OF THE DRAWINGS

Embodiments of the invention will now be described, by way of example only, with reference to the drawings, in which.

DESCRIPTION OF PREFERRED EMBODIMENTS

Figure 1A:
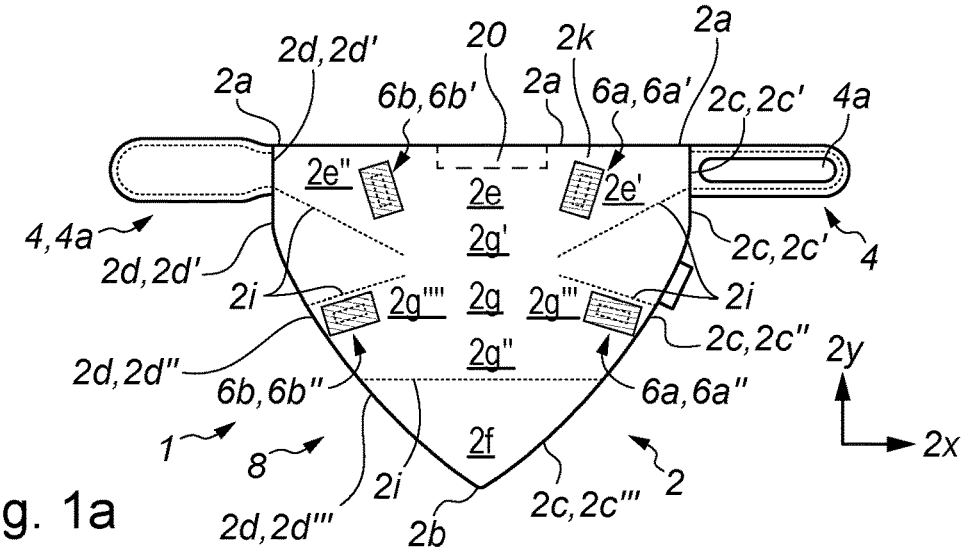
FIG. 1*a* is a front view of a garment according to the present invention.

With reference to FIGS. 1*a* to 5*b*, a garment 1, which can be folded into the shape of a face mask, and unfolded into a loose fitting, comfortable garment 1, is shown. The garment 1 comprises a sheet 2 of fabric material and two straps 4 (an example of a wearer attachment device). The straps 4 allow the garment 1 to be attached to the neck or head of the wearer. In other embodiments, the garment 1 could be attached to both the head and neck of the wearer, or optionally the head and/or neck of the wearer.

The sheet 2 of fabric is a flexible sheet 2.

The garment 1 also includes three releasable fastening devices 6*a*, 6*b*, 6*c*, and the sheet 2 of fabric is configurable between a first unfolded position 8 and a second folded position 9. The garment 1 is configured to be more comfortable, in use, for the wearer when in the first unfolded position 8 than in the second folded position 9.

The sheet 2 is held in the second folded position 9 by the releasable fastening devices 6*a*, 6*b*, 6*c*. In the second folded position 9 the sheet 2 of fabric is folded into the shape of a face mask that, in use, allows the garment 1 to cover at least a portion of the wearer's mouth and nose, and in this embodiment the garment 1 is configured as a face shield, or face covering, when in the second folded position 9, and is a protective covering. This transition can be done rapidly, and makes the invention well suited for moving between areas of relative safety (such as a park or open space) to an environment of greater risk (such as public transport). Thus, the present invention allows the wearer to be more comfortable in safer environments, by wearing the garment 1 in the first unfolded position 8, and to sacrifice comfort when in environments of greater risk by switching to mask mode (the second folded position 9).

The garment 1 comprises a filter element receiving portion 12 configured to receive one or more filter elements 14 configured to filter one or more hazardous substances from air to be inhaled by the wearer and/or air to be exhaled by the wearer. The filter element 14 could be customised for use with the garment 1 or may be an off the shelf filter element. It will be understood that a part of a filter element 14 from a known face mask could be added to the filter receiving portion 12 in the absence of other filter elements 14.

In the embodiments illustrated and described here, the garment 1 is a bandana, and may be considered a bandana mask due to its ability to switch between a bandana mode and a mask mode. However, it should be appreciated that in other embodiments the garment 1 could be formed of, or include any wearable item, such as an item of clothing, scarf, bandana, headgear, headwear, neck garment, neckwear, neckgear, and face covering. In the first unfolded position 8 the garment 1 is wearable as a bandana, scarf, face covering, head covering, headwear, neckwear, and/or worn loosely around the wearer. In the first unfolded position 8 the garment 1 is wearable around the user's neck and/or pulled up around the user's face, optionally around at least a part of the user's nose. In the first unfolded position 8 the garment 1 is wearable around the user's head, neck, and/or upper torso. In the first unfolded position 8 the garment 1 can be arranged to be substantially planar. In the first unfolded position 8 the garment 1 can be arranged to be worn comfortably.

The garment 1 is a substantially planar member when the sheet 2 of fabric is in the first unfolded position 8, as the sheet 2 and the straps 4 are planar members. This makes the garment 1 easy to store or transport.

In the embodiments illustrated and described here, in the second folded position 9 the garment 1 is arranged to cover most of the lower portion of the wearer's face and a portion of the upper portion of the user's face (by covering a part of the bridge of the nose).

In the second folded position 9, the garment 1 is arranged to cover, be in contact with, and arranged to form an airtight seal with at least a portion of the wearer's nose, at least a portion of the bridge of the wearer's nose, at least a portion of the wearer's cheekbones, at least a portion of the wearer's cheeks, at least a portion of the wearer's jaws, at least a portion of the underside of the wearer's jaws, at least a portion of the wearer's chin, and at least a portion of the underside of the wearer's chin. In other embodiments, the garment 1 could be configured to cover different parts of the user's face than that shown here.

In the embodiments illustrated and described here, the garment 1 is configured to be reversibly sealable to at least a part of the wearer's face, as the garment 1 can be sealed to at least a part of the wearer's face by the wearer configuring the sheet 2 of fabric from the first unfolded position 8 to the second folded position 9, and can be unsealed by configuring the garment 1 back to the first unfolded position 8. This can be implemented quickly and easily by the wearer of the garment 1.

In the second folded position 9, at least a portion of the garment 1 is shaped to match the contours of at least a portion of the wearer's nose, at least a portion of the bridge of the wearer's nose, at least a portion of the wearer's cheekbones, at least a portion of the wearer's cheeks, at least a portion of the wearer's jaw, at least a portion of the underside of the wearer's jaw, at least a portion of the wearer's chin, and at least a portion of the underside of the wearer's chin. The garment 1 is shaped to match the curvature of the same parts of the wearer's face.

In the embodiments illustrated and described here, in the second folded position 9 the garment 1 comprises a plurality of contact points configured to be in contact with at least a portion of the wearer's face. The contact points define a continuous, substantially uninterrupted contact area between at least a portion of the garment 1 and the wearer's face. There are no gaps in the contact area between the garment 1 and the wearer, which mitigates the risk of unfiltered air reaching the wearer's mouth and/or nose when the garment 1 is in the second folded position 9 (and similarly mitigates unfiltered exhaled air from the wearer exiting the garment 1).

In the second folded position 9, the contact area between the garment 1 and the wearer's face defines a substantially elliptical shape.

The sheet 2 of fabric comprises a horizontal axis 2*x* and a vertical axis 2*y*. The horizontal axis 2*x* is arranged to be horizontal, and the vertical axis 2*y* is arranged to be vertical, when the garment 1 is in use by the wearer standing substantially vertically, or e.g. sitting with their upper torso in a vertical orientation.

The sheet 2 of fabric includes an upper edge 2*a* and a lower edge 2*b* arranged at opposite ends of the sheet 2 and spaced apart along the vertical axis 2*y*. The sheet 2 includes a left side edge 2*c* and a right side edge 2*d* arranged at opposite ends of the sheet 2 and spaced apart along the horizontal axis 2*x*. The left side edge 2*c* includes an upper side edge 2*c*' located adjacent to the upper edge 2*a* of the sheet 2, a lower side edge 2*c*''' located adjacent to the lower edge 2*b* of the sheet 2, and a mid side edge 2*c*'' located between the upper side edge 2*c*' and the lower side edge 2*c*'''. The right side edge 2*d* also includes an upper side edge 2*d*', a mid side edge 2*d*'' and a lower side edge 2*d*''' arranged in the same way.

The sheet includes an upper portion 2*e* located adjacent to the upper edge 2*a*, a lower portion 2*f* located adjacent to the lower edge 2*b*, and a mid portion 2*g* located between the lower portion 2*f* and the upper portion 2*e*. The mid portion 2*g* includes an upper mid portion 2*g*' located adjacent to the upper portion 2*e* of the sheet 2, and a lower mid portion 2*g*'' located adjacent to the lower portion 2*f* of the sheet 2.

In the embodiments illustrated and described here, the filter element 14 is disposable. The filter element receiving portion 12 includes a pocket 12*a* for receiving the filter element 14 and an opening 12*b* (an example of an access point) for adding or removing the filter element 14 to or from the filter element receiving portion 12. The opening 12*b* is reversibly securable, such that the filter element 14 can be secured therein.

The filter element receiving portion 12 is located at the upper portion 2*e* and the upper mid portion 2*g*' of the sheet 2 of fabric, and is located at a portion of the sheet 2 that, in use, is at or near to the mouth and/or nose of the wearer when the sheet 2 of fabric is in the second folded position 9.

The filter element receiving portion 12 defines a substantially rectangular section for receiving the filter element 14 therein. The filter element receiving portion 12 is spaced apart from the edges 2*a*, 2*b*, 2*c*, 2*d*, 2*c*', 2*c*", 2*c*'", 2*d*', 2*d*", 2*d*'" of the sheet 2.

The filter element receiving portion 12 is located at an inner surface 2*h* of the sheet 2 of fabric. Thus, the filter element receiving portion 12 is not visible to observers of the outer side 2*k* of the sheet 2 when the garment 1 is in the second folded position 9.

The filter element receiving portion 12 is substantially planar, which makes the garment 1 more comfortable for the wearer, especially in the first unfolded position 8.

The filter element 14 is shaped to correspond to the shape of the filter element receiving portion 12 and is substantially rectangular, although it will be appreciated that other shapes of filter element 12 could be used. The filter element 14 comprises five filter layers and is configured to filter approximately 95% or more of particulate matter and/or hazardous material from the air to be inhaled/exhaled by the wearer, as is known in the field of air filter elements.

Figure 1B:
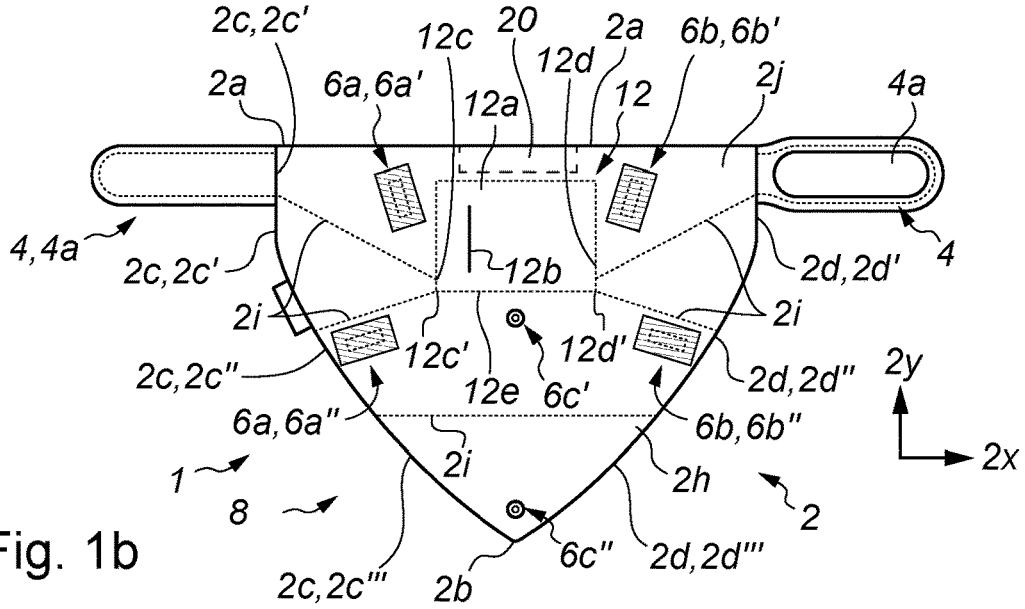
FIG. 1*b* is a rear view of the garment of FIG. 1*a;*

In the embodiment illustrated in FIGS. 1*a* and 1*b*, the garment 1 is configured to filter at least a portion of the air to be inhaled and exhaled by the wearer when the sheet 2 is in the first unfolded position 8 and worn around the user's mouth and/or nose. In this embodiment, the garment 1 is configured to filter a higher percentage of the air to be inhaled and/or exhaled by the wearer when the sheet 2 is in the second folded position 9 than in the first unfolded position 8. Therefore, in the first unfolded position 8, the garment 1 provides some degree of protection to the wearer, but if more protection is required, the second folded position 9 can be used.

The garment 1 is configured to filter all of the air to be inhaled and exhaled when the sheet 2 is in the second folded position 9. In the embodiment illustrated in FIGS. 5*a* and 5*b*, the garment 1 is configured to filter only the air that is inhaled by the wearer, and not exhaled air from the wearer.

The sheet 2 comprises a plurality of predetermined fold lines 2*i* configured to determine, at least in part, how the sheet 2 of fabric is foldable from the first unfolded position 8 to the second folded position 9.

In the second folded position 9, at least a portion of the garment 1, and the sheet 2 thereof, is spaced apart from the wearer's mouth and/or nose, such that at least one cavity is formed between the sheet 2 of fabric and the wearer's face, which makes the garment 1 more comfortable to wear in the second folded position 9. This is due to the one or more fold lines 2*i* of the garment 1 being configured to project at least a portion of the sheet 2 of fabric away from the wearer's mouth and/or nose. Furthermore, the filter element receiving portion 12 (and thus the filter element 14) is located at a portion of the sheet 2 that is arranged to be spaced apart from the wearer's mouth and/or nose when the sheet 2 is in the second folded position 9. In this embodiment, at least a portion of the filter element 14 is spaced apart from the wearer's face when the garment 1 is in use and the sheet 2 is in the second folded position 9.

In the second folded position 9, the fold lines 2*i* form frame members of a frame. The frame members formed by the fold lines 2*i* provide support to the garment 1 in the second folded position 9. The frame members are ribs formed by the fold lines 2*i*. In the embodiments illustrated and described here, when the sheet 2 of fabric is folded along the fold lines 2*i*, the frame formed by the fold lines 2*i* assists in holding, or maintaining, the sheet 2 of fabric in the second folded position 9, which helps to maintain the cavity between the sheet 2 of fabric and the wearer's face.

The fold lines 2*i* are defined by stitched portions of the sheet 2, although it will be appreciated that other ways of creating a fold line 2*i* could be used.

In the embodiment illustrated and described here the fold lines 2*i* are located at an inner side 2*j* of the sheet 2 of fabric and at an outer side 2*k* of the sheet 2.

One of the fold lines 2*i* is arranged from a left upper side edge 2*c*' of the sheet 2 to the upper mid portion 2*g*' of the sheet 2 in the direction of the horizontal axis 2*x* of the sheet 2. The direction of this fold line 2*i* is angularly offset from the horizontal axis 2*x* and is diagonally down from the left side edge 2*c*' of the sheet 2 to the upper mid portion 2*g*' of the sheet 2 along the horizontal axis 2*x*. This fold line 2*i* is substantially linear, and also runs from the left upper side edge 2*c*' of the sheet 2 to a left side edge portion 12*c* of the filter receiving portion 12.

One of the fold lines 2*i* is arranged from the left mid side edge 2*c*" of the sheet 2 to the upper mid portion 2*g*' of the sheet 2. The direction of the fold line 2*i* is along the horizontal axis 2*x* of the sheet 2. The direction of the fold lines 2*i* is angularly offset from the horizontal axis 2*x* of the sheet 2 and is diagonally up from the left side edge 2*c*' of the sheet 2 to the upper mid portion 2*g*' of the sheet 2 along the horizontal axis 2*x*. This fold line 2*i* is substantially linear, and also runs from the left mid side edge 2*c*" of the sheet 2 to a left side edge portion 12*c* and a left lower corner portion 12*c*' of the filter receiving portion 12.

One of the fold lines 2*i* is arranged from a right upper side edge 2*d*' of the sheet 2 to the upper mid portion 2*g*' of the sheet 2 in the direction of the horizontal axis 2*x* of the sheet 2. The direction of this fold line 2*i* is angularly offset from the horizontal axis 2*x* and is diagonally up from the right side edge 2*c*' of the sheet 2 to the upper mid portion 2*g*' of the sheet 2 along the horizontal axis 2*x*. This fold line 2*i* is substantially linear, and also runs from the right upper side edge 2*c*' of the sheet 2 to a right side edge portion 12*d* of the filter receiving portion 12.

One of the fold lines 2*i* is arranged from the right mid side edge 2*d*" of the sheet 2 to the upper mid portion 2*g*' of the sheet 2. The direction of the fold line 2*i* is along the horizontal axis 2*x* of the sheet 2. The direction of the fold lines 2*i* is angularly offset from the horizontal axis 2*x* of the sheet 2 and is diagonally up from the right side edge 2*d*' of the sheet 2 to the upper mid portion 2*g*' of the sheet 2 along the horizontal axis 2*x*. This fold line 2*i* is substantially linear, and also runs from the right mid side edge 2*d*" of the sheet 2 to a right side edge portion 12*d* and a left lower corner portion 12*d*' of the filter receiving portion 12.

One of the fold lines 2*i* is arranged from the left lower side edge 2*c*'" of the sheet 2 to the right lower side edge 2*d*'" of the sheet 2 along the horizontal axis 2*x* of the sheet 2. The direction of this fold line 2*i* is parallel to the horizontal axis 2*x* of the sheet 2. The fold line 2*i* is substantially linear and is arranged to be parallel to a lower side edge 12*e* of the filter receiving portion 12.

Two sets of fold lines 2*i* are convergent. The fold lines 2*i* are arranged to converge from each side edge 2*c*, 2*d*, of the sheet 2 towards the centre of the sheet 2 in the direction of the horizontal axis 2*x*. The convergent sets of fold lines 2*i* are arranged to converge from the side edges 2*c*, 2*d* of the sheet 2 towards the filter element receiving portion 12.

The filter element receiving portion 12 is located adjacent to one or more of the fold line(s) 2*i*.

The sheet 2 is configured to permit air to flow from the outer side 2*k* thereof to the inner side 2*j* thereof through at least a portion of the sheet 2. In use, the outer side 2*k* faces the surrounding environment and the inner side 2*j* faces the wearer.

The sheet 2 is configured to prevent air from flowing through at least a portion thereof. Thus, in the embodiments illustrated and described here, the sheet 2 is configured to permit air to flow through one or more portions thereof and to prevent air from flowing through one or more portions thereof.

In the embodiment illustrated in FIGS. 1*a* to 4*c*, the sheet 2 is configured to permit air to flow from the outer side 2*k* thereof through the filter receiving portion 12 to the inner side 2*j* of the sheet 2 and to prevent air from flowing through the other portion(s) of the sheet 2.

Figure 1C:
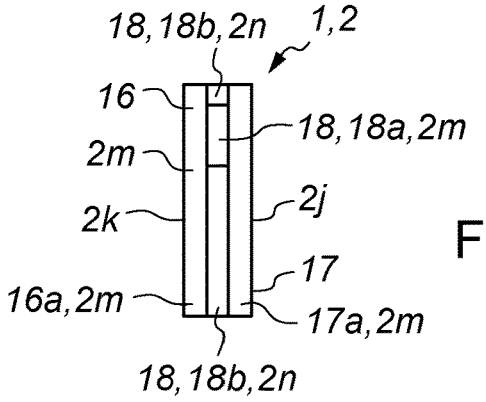
FIG. 1*c* is a partial side sectional view of the garment of FIG. 1*a;*
Figure 2A:
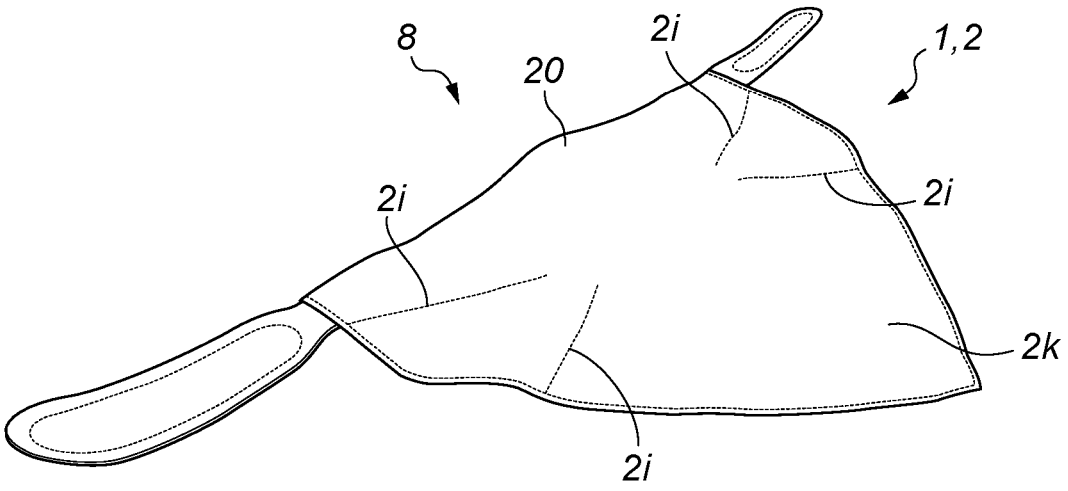
FIGS. 2*a* to 2*f* show photographs of the garment of FIG. 1*a;*
Figure 2B:
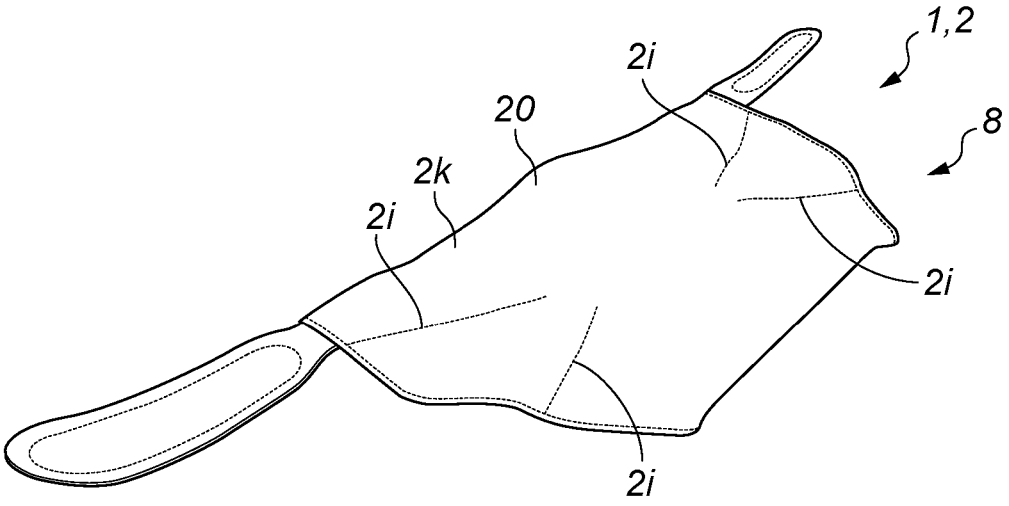
Figure 2C:
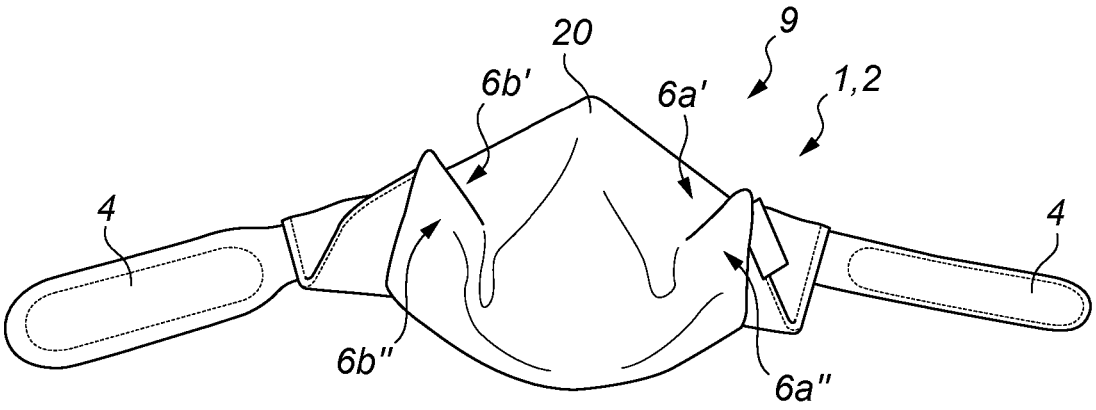
Figure 2D:
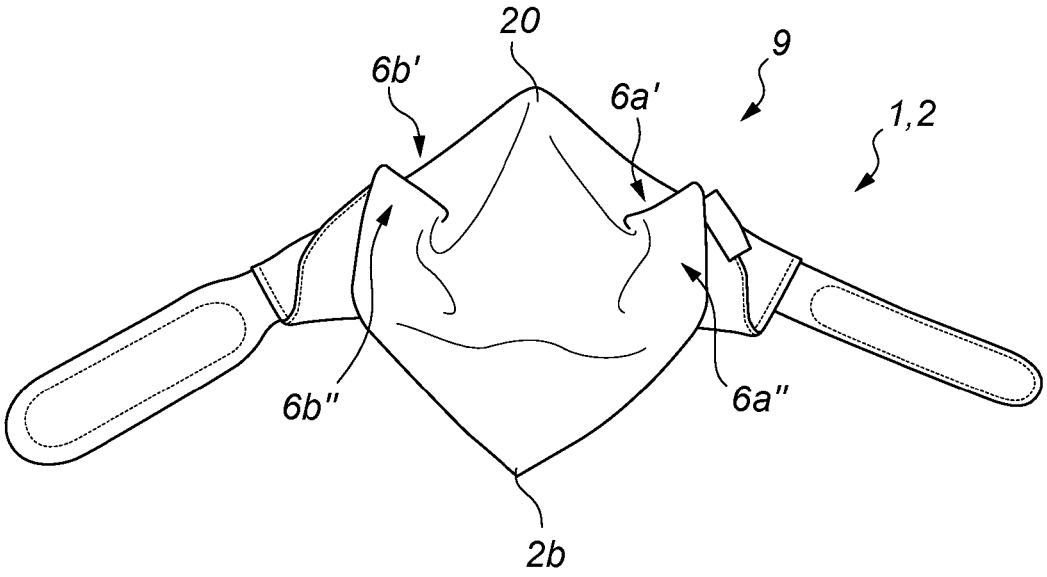
Figure 2E:
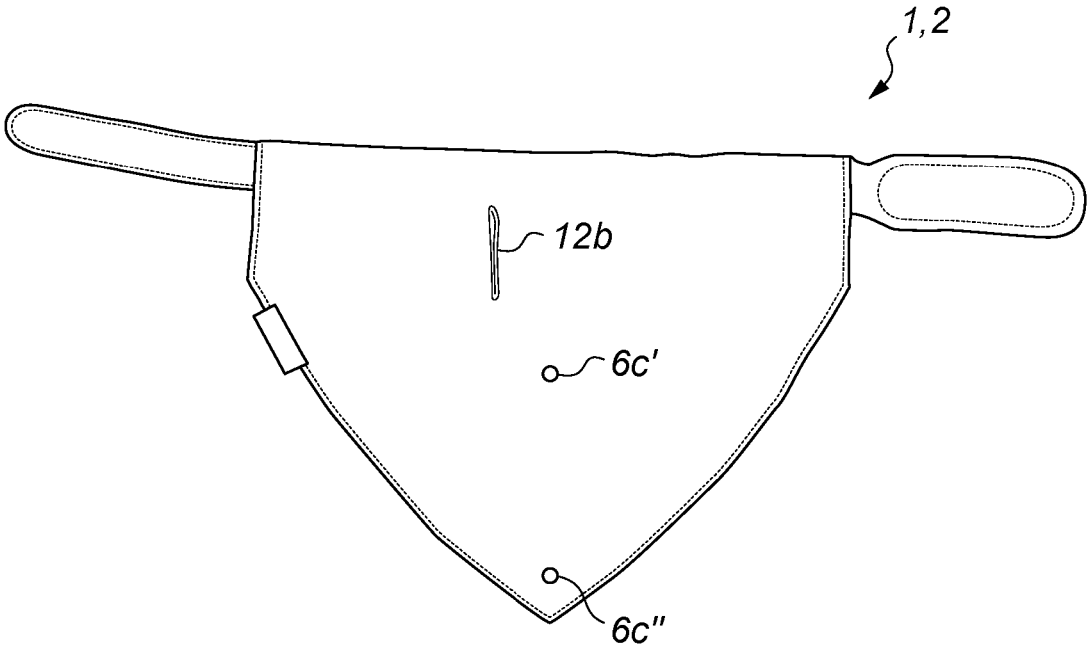
Figure 2F:
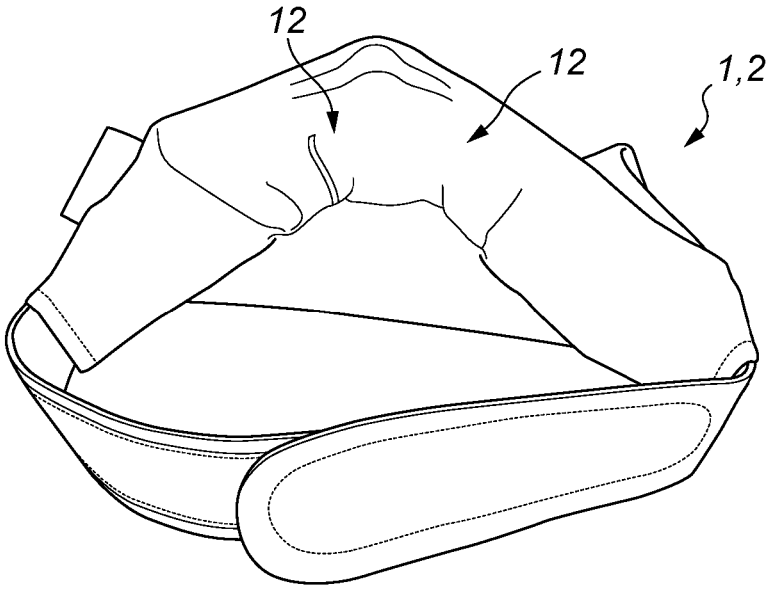

FIG. 1*c* shows a side sectional view of the sheet 2. The sheet 2 comprises one or more porous sections 2*m* configured to permit air to flow therethrough and one or more non-porous sections 2*n* configured to prevent air from flowing therethrough. At least a portion of the, or each, porous section 2*m* is arranged to overlay at least a portion of the filter element receiving portion 12.

The sheet 2 of fabric comprises a first layer 16, second layer 17 and third layer 18, which are fabric layers.

The first layer 16 includes the outer side 2*k* of the sheet 2 and the second layer 17 includes the inner side 2*j* of the sheet 2.

As shown in FIG. 1*c*, the first layer 16 includes one of the porous sections 12*m* of the sheet 2 and the second layer 17 includes another porous section 12*m* of the sheet 2. In the embodiments illustrated and described here, substantially all of the first layer 16 is porous and substantially all of the second layer 17 is porous.

In the embodiments illustrated and described here, the second layer 17 includes the filter element receiving portion 14.

The first layer 16 is located adjacent to the third layer 18, and the third layer 18 is located adjacent to the second layer 17. The third layer 18 is located between the first and second layers 16, 17. The first layer 16 is connected to the third layer 18 and the third layer 18 is connected to the second layer 17.

The third layer 18 includes one or more of the non-porous sections 2*n* of the sheet 2 of fabric. The third layer 18 includes one or more of the porous sections 12*m* of the sheet 2 of fabric. The porous section 18*a* of the third layer 18 includes a single hole located at the upper mid portion 2*g*' of the sheet 2.

The porous section 18*a* of the third layer 18 is arranged to at least partially overlay the filter element receiving portion 12. The non-porous sections 18*b* of the third layer 18 are arranged to prevent air from flowing from the porous section 16*a* of the first layer 16 to the porous section 17*a* of the second layer 17 without passing through the filter element receiving portion 12.

The first layer 16 and the second layer 17 are made from air-permeable, breathable materials, and typically include polyester. It will be understood that a wide range of suitable materials could be used for the sheet 2 of fabric and the garment 1. The third layer 18 is made from a woven fabric material coated with polyurethane.

The garment 1 is configured to be machine washable and is configured to be compatible with one or more antimicrobial or antibacterial processes.

The first layer 16, second layer 17 and third layers 18 are planar layers and are substantially congruent.

The sheet 2 could comprise one or more antibacterial agents or antimicrobial agents, which could be added by the wearer prior to use, or could be integrated in the sheet 2. The first layer 16 and second layer 17 could comprise the one or more antibacterial or antimicrobial agents. The outer side 2*k* and/or the inner side 2*j* of the sheet 2 could comprise the one or more antibacterial or antimicrobial agents.

The releasable fastening device of the garment 1 includes two sets of magnets 6*a*, 6*b* (example connection members) and two press studs 6*c* (example connection members). It will be understood that other combinations of releasable fastening device are possible, such as snap fit connectors, hook and loop fasteners, hooks, buttons, buckles, hooks, and/or any other suitable releasable fastening device capable of fastening one portion of the sheet 2 to another portion of the sheet 2.

The press studs 6*c* of the releasable fastening device of the garment 1 are located on the inner surface 2*h* of the sheet 2, whereas the magnets 6*a*, 6*b* of the releasable fastening device are located at least partially within the sheet 2 and are covered by the sheet 2.

In the embodiments illustrated and described here, the magnets 6*a*, 6*b* of the releasable fastening device of the garment 1 are adjustable, as they can be connected at different positions relative to one another, and are connectable to each other at three or more contact points. This allows the garment 1 to fit a variety of face sizes in the second folded position 9, as the arrangement of the sheet 2 is adjustable. Therefore, in the embodiments illustrated here, the sheet 2 is adjustable into a number of different second folded positions 9 by connecting the magnets 6*a*, 6*b* at different connection points.

In the embodiments illustrated and described here, one magnet 6*a*' is located at a left upper portion 2*e*' of the sheet 2 of fabric and the corresponding magnet 6*a*" is located at a left mid portion 2*g*"' of the sheet 2 of fabric. One magnet 6*b*' is located at a right upper portion 2*e*" of the sheet 2 of fabric and the corresponding magnet 6*b*" is located at a right mid portion 2*g*"" of the sheet 2 of fabric. One press stud 6*c*' is located at the mid portion 2*g* of the sheet 2 of fabric and the corresponding press stud 6*c*" is located at the lower portion 2*f* of the sheet 2 of fabric.

In the embodiments illustrated and described here, the releasable fastening device 6*a*, 6*b*, 6*c*, and the connection members thereof 6*a*', 6*a*", 6*b*', 6*b*", 6*c*', 6*c*" are spaced apart from the fold lines 2*i* of the sheet 2 of fabric and are spaced apart from the filter receiving portion 12.

One magnet 6*a*' is located adjacent to the left side edge 12*c* of the filter receiving portion 12 and is located adjacent to the upper edge 2*a* of the sheet 2. The corresponding magnet 6*a*" is located adjacent to the left mid side edge 2*c*" of the sheet 2 of fabric.

One magnet 6*b*' is located adjacent to the right side edge 12*d* of the filter receiving portion 12 and is located adjacent to the upper edge 2*a* of the sheet 2. The corresponding magnet 6*b*" is located adjacent to the right mid side edge 2*d*" of the sheet 2 of fabric.

The sheet 2 comprises a malleable section 20 located within the sheet 2, which is deformable from a first position to a second position. In this embodiment, the malleable section 20 is a nose clip made from a malleable metal, which the wearer can deform around at least a portion of the bridge of their nose, to ensure a better fit between the garment 1 and the wearer's nose. This is particularly useful to ensure that the garment 1 does not slip from the wearer's nose during use, and to obtain a better seal between the sheet 2 and the wearer's face. The malleable section 20 is configured to remain in the second position until the wearer applies a force thereto. The malleable section 20 is located at the upper portion 2*e* of the sheet 2 and is adjacent to the upper edge 2*a*.

The malleable section 20 can be deformed by the wearer when the sheet 2 is in the first unfolded position 8 and/or the second folded position 9, and is deformable to the shape of at least a portion of the wearer's nose.

Figure 4A:
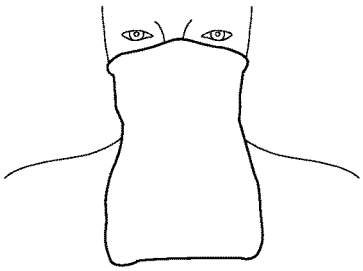
FIGS. 4*a* to 4*c* show further photographs of how the garment of FIG. 1*a* could be used.
Figure 4B:
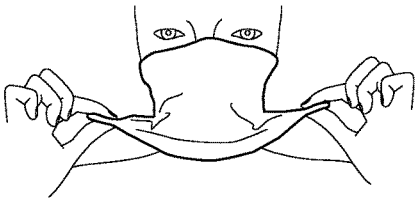
Figure 4C:
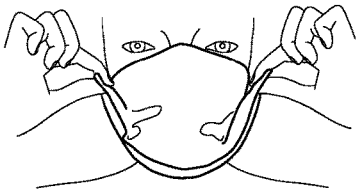
Figure 5A:
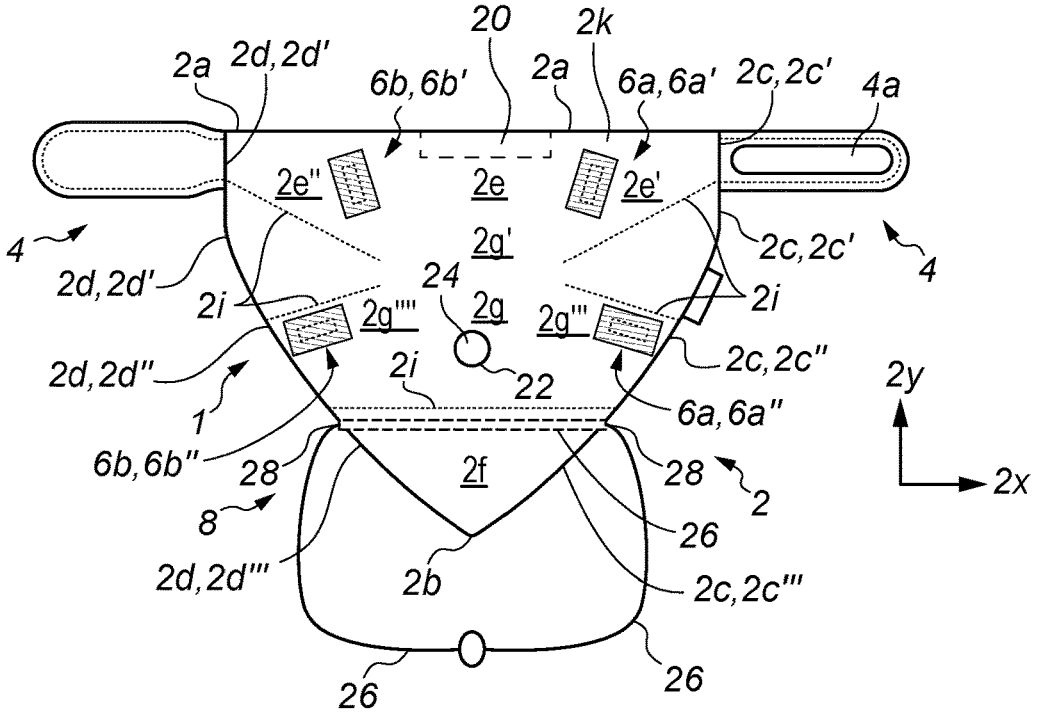
FIG. 5*a* shows a front view of an alternative embodiment of the garment of FIG. 1*a*.
Figure 5B:
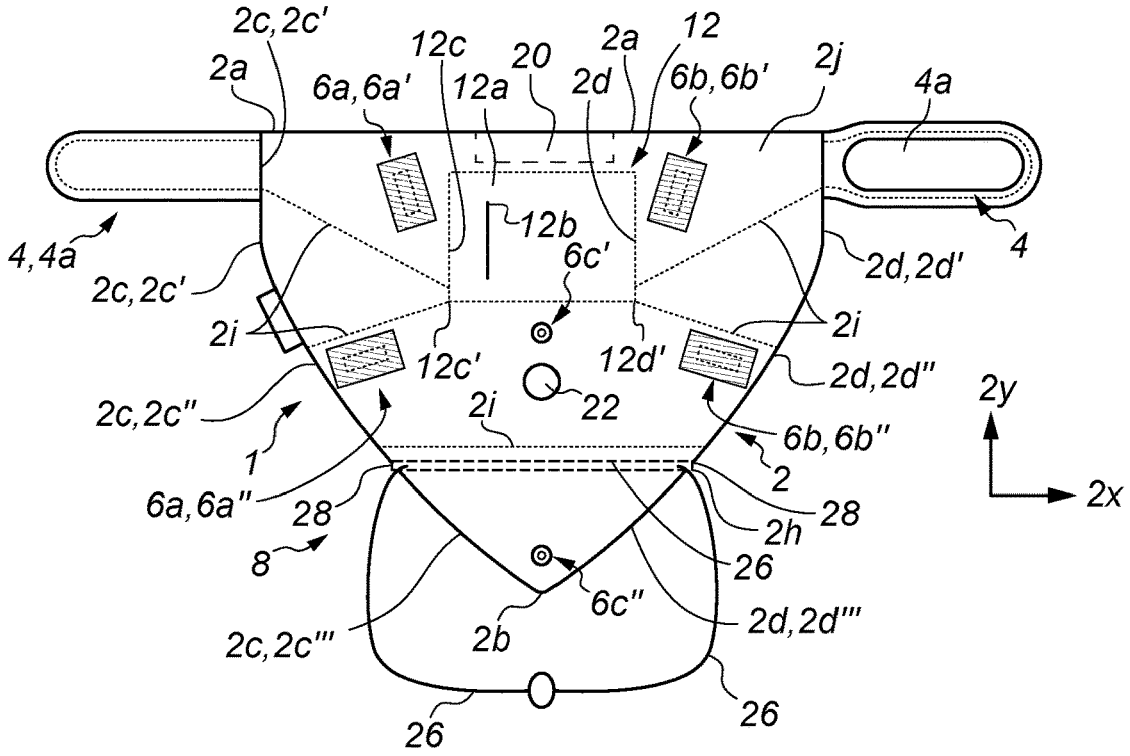
FIG. 5*b* shows a rear view of the alternative embodiment of the garment of FIG. 5*a*.

Another embodiment of the invention is shown in FIGS. 5*a* and 5*b*. This embodiment is substantially identical to that shown in FIGS. 1*a* to 4*c*, with the addition that the sheet 2 of fabric comprises a valve device 22 operable between a first position, in which air is prevented from flowing from the inner side of the sheet through the valve device 22 to the outer side 2*k* of the sheet 2 and a second position, in which air is permitted to flow from the inner side 2*j* of the sheet 2 through the valve device 22 to the outer side 2*k* of the sheet 2.

The garment 1 shown in FIGS. 5*a* and 5*b* also includes an adjustment device 26 operable to adjust the position of the sheet 2 relative to the wearer's face and configured to seal at least a portion of the sheet 2 against the wearer's face. The adjustment device 26 is configured to seal at least a portion of the sheet 2 against the underside of the wearer's jaw, the underside of the wearer's chin, and/or at least a portion of the wearer's cheeks.

In the embodiment illustrated in FIGS. 5*a* and 5*b*, the adjustment device 26 is a drawcord. It will be appreciated that other adjustment devices 26 could be used.

The adjustment device 26 is located at the lower portion 2*f* of the sheet 2. The sheet 2 includes two adjustment device receiving members 28 configured to receive at least a portion of the adjustment device 26.

The adjustment device receiving members 28 are loop portions. The adjustment device receiving members are located at the left lower side edge 2*c*'" and the right lower side edge 2*d*'" of the sheet 2 of fabric and adjacent to a portion of a fold line 2*i*.

Still with reference to FIGS. 5*a* and 5*b*, the valve device 22 is a one way valve configured to prevent air from flowing from the outer side 2*k* of the sheet 2 through the valve device 22 to the inner side 2*j* when the valve device 22 in the first position or when the valve device 22 is in the second position. In this embodiment, the valve device 22 only permits air to flow from the inner side 2*j* of the sheet 2 to the outer side 2*k* through the valve device 22.

In the embodiments illustrated and described here, the valve device 22 is operable from the first position to the second position in response to the wearer's exhaled breath, such that the wearer's exhaled breath operates the valve device 22 from the first position to the second position.

The valve device 22 is operable from the second position to the first position in response to the wearer's inhaled breath, such that the wearer's inhaled breath closes the valve device 22.

The valve device 22 comprises a cap 24 (an example of a locking member) for locking the valve device 22 in the first position 8. This may be useful when travelling to a territory that does not permit the use of valve devices 22 on face masks, as the wearer can then lock the valve device 22 in the first position and continue to use the garment 1 of the present invention, whilst complying with local laws and regulations. When the wearer returns to a territory that does permit the use of the valve device 22, the valve device can be unlocked by removing the cap 24 therefrom.

The cap 24 is configured to form an airtight seal when engaged with and locked to the valve device 22 and the cap 24 is operable by hand.

In the embodiments illustrated and described here, the straps 4 of the garment 1 comprise hook and loop connecting members 4*a* (an example of a releasable fastening device) for securing the straps 4 to each other. These are used to secure the garment 1 to the wearer.

The straps 4 are adjustable, as the connecting members 4 can be connected at different positions relative to one another. This allows the garment to fit different head and/or neck sizes, and allows the wearer to adjust the tightness of the garment 1 to the face/neck. For example, it may be desirable in the first unfolded position 8 to wear the garment 1 loosely, and to tighten the garment 1 in the second folded position 9.

The straps 4 comprise a resilient material, such as polychloroprene (Neoprene).

Figure 3A:
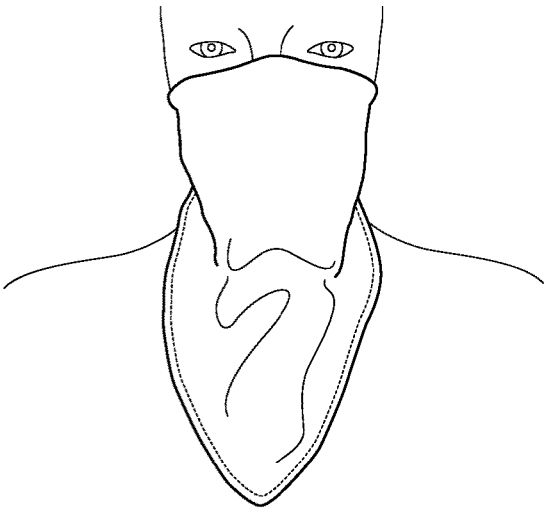
FIGS. 3*a* to 3*h* show photographs of how the garment of FIG. 1*a* could be used.
Figure 3B:
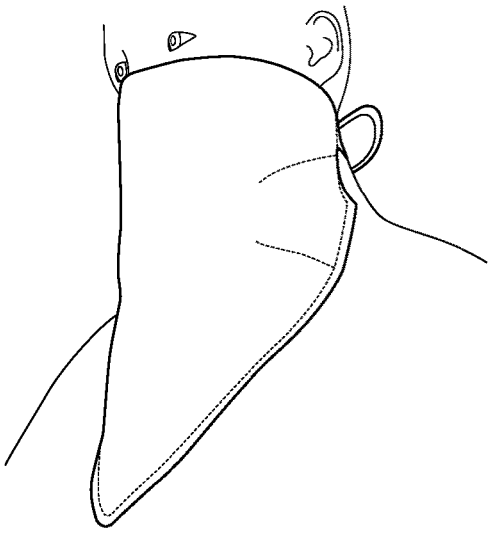
Figure 3C:
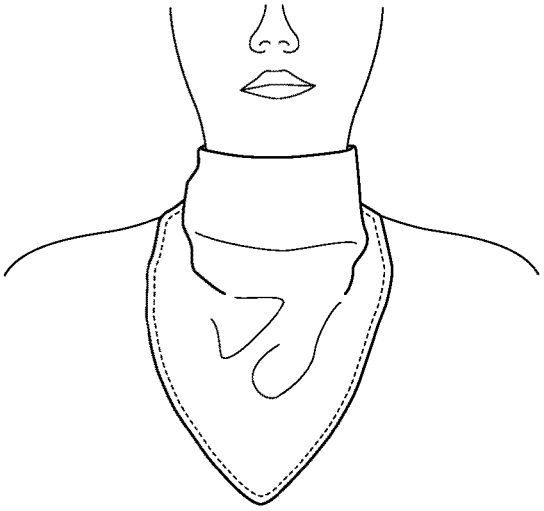
Figure 3D:
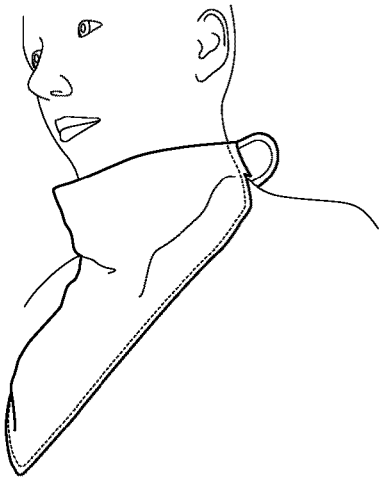

An example of how the garment 1 can be used will now be provided. Initially, the garment 1 is attached to the wearer's head using the straps 4, as shown in FIGS. 3*a* and 3*b*. This has been illustrated in FIGS. 3*a* and 3*b* with the garment in the first unfolded position 8. It will be understood that the garment 1 could be attached and removed from the wearer using the straps 4 when in the second folded position 9. FIGS. 3*c* and 3*d* show the garment 1 in the first unfolded position 8 worn around the neck, and the garment 1 can be brought up around the face, or brought down to the neck.

Figure 3E:
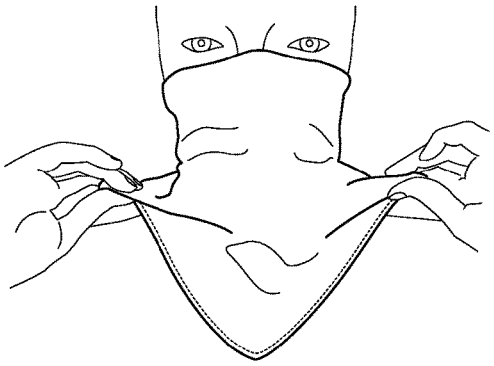
Figure 3F:
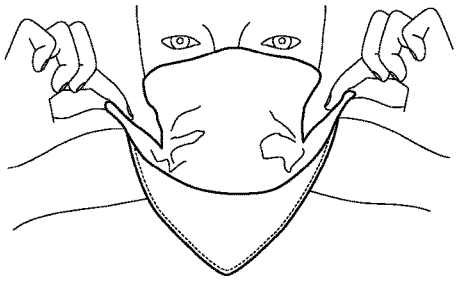
Figure 3G:
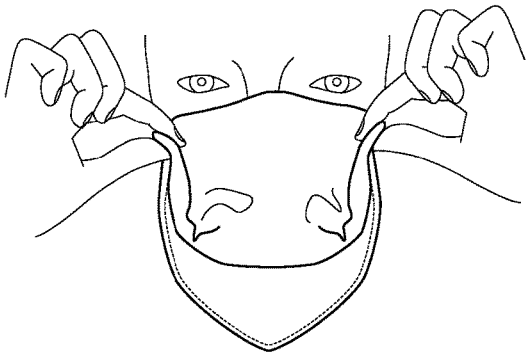
Figure 3H:
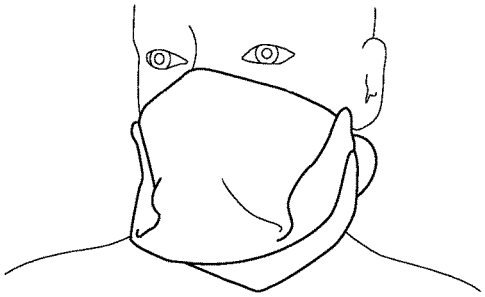

When the need arises to switch the sheet 2 of the garment 1 to the second folded position 9, the wearer grips the sheet 2 (as shown in FIG. 3*e*) and pulls the sheet 2 up towards their face (FIG. 3*f*) along the fold lines 2*i*. The user attaches the lower magnets 6*a*", 6*b*" to the upper magnets 6*a*', 6*b*' (FIG. 3*g*) to secure the sheet 2 in the second folded position 9 (FIG. 3*h*).

In the example shown in FIGS. 3*a* to 3*h*, the press studs 6*c*', 6*c*" are not connected. The garment 1 can be moved between the first unfolded position 8 and the second folded position 9 with the press studs 6*c*', 6*c*" connected or unconnected. As shown in FIG. 4*a*, the garment 1 is worn around the face, with the press studs 6*c*', 6*c*" connected to each other (which is done by folding the lower portion 2*f* of the sheet 2 towards the inner side 2*j* of the sheet 2 and engaging the press studs 6*c*', 6*c*" together)

Next, the garment 1 is configured in the same was as that described in relation to FIGS. 3*e* to 3*h*, with the wearer pulling the sheet 2 up (FIG. 4*b*) and attaching the magnets 6*a*' and 6*a*", and 6*b*' and 6*b*", to each other (FIG. 4*c*) to configure the garment 1 in the second folded position 9.

The garment 1 of the present invention is advantageous due to its ability to be transformed from a loose fitting, comfortable garment 1, to a tight fitting, protective face mask. This allows the wearer to feel safe in hazardous environments, and to feel comfortable in safer environments. The garment 1 is also more aesthetically pleasing than known protective equipment, which is thought by the present inventors to increase the likelihood that the wearer will choose to wear a protective face covering.

Modifications may be made to the foregoing embodiments without departing from the scope of the present invention. For example, the garment 1 could be configured to be worn at least partially around, or on, the neck and/or head of the wearer. The garment 1 could be configured to be worn around, or on, the upper body, or upper portion of the torso of the wearer.

The second folded position 9 is a mask mode, or face mask mode, however, the sheet 2 could be folded into the shape of, or substantially resemble the shape of any suitable face mask, such as a surgical face mask, N95 face mask, dust mask, or the like.

The garment 1 could comprise a plurality of filter element receiving portions 12, each filter element receiving portion 12 being configured to receive at least one filter element 14.

The sheet 2 of fabric could include at least one filter element 14, and there may be no need for a filter element receiving portion 12. For example, at least a portion of the sheet 2 could be configured as the filter element 14. In other embodiments, the garment 1 could comprise any suitable number and arrangement of filter element receiving portions 12 and/or filter elements 14.

Although in the embodiments illustrated and described here the garment 1 comprises a single sheet 2 of fabric material (having three layers), in other embodiments the garment 1 could comprise a plurality of sheets 2 of fabric material, and the sheet(s) 2 could comprise any suitable number of layers.

Although straps 4 have been used as a wearer attachment device, the garment 1 could comprise one or more releasable fastening devices for securing the wearer attachment device to the user, and the releasable fastening device(s) could include at least one of: magnets, hook and loop fasteners, buttons, snap fit connectors, buckles, hooks, or the like, or any suitable device for fastening the wearer attachment device.

The wearer attachment device could be releasably attachable to the sheet 2 of fabric.

Although the embodiments illustrated and described here include two sets of magnets 6*a*, 6*b*, and a pair of press studs 6*c*, it will be understood that any suitable number, type and arrangement of releasable fastening device(s) could be used to secure one part of the sheet 2 to another part.

Whilst the embodiments depicted here show a portion of the wearer's face being covered by the garment 1, it will be understood that other embodiments could cover a different portion of the wearer's face, including substantially all of the wearer's face.

The invention claimed is:

1. A garment comprising:

a sheet of fabric material;

a wearer attachment device, the wearer attachment device being configured to allow the garment to be attached to the neck or head of the wearer; and one or more releasable fastening devices;

wherein the sheet of fabric is configurable between a first unfolded position and a second folded position;

wherein in the second folded position the sheet of fabric is folded into the shape of a face mask that, in use, allows the garment to cover at least a portion of the wearer's mouth and nose;

wherein the sheet of fabric is held in the second folded position by the one or more releasable fastening devices;

wherein the sheet comprises one or more predetermined fold lines configured to determine, at least in part, how the sheet of fabric is foldable from the first unfolded position to the second folded position; and wherein in the second folded position, the fold lines form frame members of a frame, wherein the frame members formed by the fold lines provide support to the garment in the second folded position, such that the fold lines assist in holding, or maintaining, the sheet of fabric in the second folded position.

2. The garment of claim 1, wherein the garment comprises a bandana element, a scarf element, a headwear, or headgear element, and/or a neckwear, or neckgear element.

3. The garment of claim 1, wherein in the second folded position the garment is arranged to cover at least a lower portion of the wearer's face, at least a portion of the lower half of the wearer's face, the majority of the wearer's face, and/or at least an upper portion of the user's face.

4. The garment of claim 1, wherein the releasable fastening device of the garment includes one or more magnets, press studs, snap fit connectors, hook and loop fasteners, hooks, buttons, buckles, and/or hooks.

5. The garment of claim 1, wherein the sheet comprises one or more malleable sections, the malleable section(s) being deformable from a first position to a second position, the malleable sections being configured to remain in the second position until the wearer applies a force thereto, and wherein the malleable section is configured, in use, to fit around at least a portion of the wearer's nose, or a portion of the bridge of the user's nose.

6. The garment of claim 5, wherein the sheet comprises one or more metals, malleable portions, malleable metals, and/or flexible metals, which defines the malleable section (s) of the sheet.

7. A garment comprising:

a sheet of fabric material;

a wearer attachment device, the wearer attachment device being configured to allow the garment to be attached to the neck or head of the wearer; and one or more releasable fastening devices;

wherein the sheet of fabric is configurable between a first unfolded position and a second folded position;

wherein in the second folded position the sheet of fabric is folded into the shape of a face mask that, in use, allows the garment to cover at least a portion of the wearer's mouth and nose;

wherein the sheet of fabric is held in the second folded position by the one or more releasable fastening devices;

wherein the sheet comprises one or more predetermined fold lines configured to determine, at least in part, how the sheet of fabric is foldable from the first unfolded position to the second folded position; and wherein the one or more fold lines of the garment are configured to project at least a portion of the sheet of fabric away from the wearer's mouth and/or nose.

8. The garment of claim 7, wherein the garment comprises a bandana element, a scarf element, a headwear, or headgear element, and/or a neckwear, or neckgear element.

9. The garment of claim 7, wherein in the second folded position the garment is arranged to cover at least a lower portion of the wearer's face, at least a portion of the lower half of the wearer's face, the majority of the wearer's face, and/or at least an upper portion of the user's face.

10. The garment of claim 7, wherein in the second folded position, the garment is arranged to be in contact with at least a portion of the wearer's nose, at least a portion of the bridge of the wearer's nose, at least a portion of the wearer's cheekbones, at least a portion of the wearer's cheeks, at least a portion of the wearer's jaws, at least a portion of the underside of the wearer's jaws, at least a portion of the wearer's chin, at least a portion of the underside of the wearer's chin, and/or at least a portion of the wearer's neck.

11. The garment of claim 7, wherein in the second folded position, at least a portion of the garment is shaped to match the contour(s) of at least a portion of the wearer's nose, at least a portion of the bridge of the wearer's nose, at least a portion of the wearer's cheekbones, at least a portion of the wearer's cheeks, at least a portion of the wearer's jaw, at least a portion of the underside of the wearer's jaw, at least a portion of the wearer's chin, at least a portion of the underside of the wearer's chin, and/or at least a portion of the wearer's neck.

12. The garment of claim 7, wherein in the second folded position the garment comprises one or more contact points configured to be in contact with at least a portion of the wearer's face, and wherein the contact points define a continuous, substantially uninterrupted contact area between at least a portion of the garment and the wearer's face.

13. The garment of claim 12, wherein the contact area includes at least a portion of the wearer's nose, at least a portion of the bridge of the wearer's nose, at least a portion of the wearer's cheekbones, at least a portion of the wearer's cheeks, at least a portion of the wearer's jaws, at least a portion of the underside of the wearer's jaws, at least a portion of the wearer's chin, at least a portion of the underside of the wearer's chin, and/or at least a portion of the wearer's neck.

14. The garment of claim 7, wherein in the second folded position, at least a portion of the garment is spaced apart from the wearer's mouth and/or nose.

15. The garment of claim 7, wherein the releasable fastening device of the garment includes one or more magnets, press studs, snap fit connectors, hook and loop fasteners, hooks, buttons, buckles, and/or hooks.

16. A garment comprising:

a sheet of fabric material;

a wearer attachment device, the wearer attachment device being configured to allow the garment to be attached to the neck or head of the wearer; and one or more releasable fastening devices;

wherein the sheet of fabric is configurable between a first unfolded position and a second folded position;

wherein in the second folded position the sheet of fabric is folded into the shape of a face mask that, in use, allows the garment to cover at least a portion of the wearer's mouth and nose;

wherein the sheet of fabric is held in the second folded position by the one or more releasable fastening devices; and wherein the sheet is configured to permit air to flow through one or more portions thereof and to prevent air from flowing through one or more portions thereof.

17. The garment of claim 16, wherein the garment comprises a bandana element, a scarf element, a headwear, or headgear element, and/or a neckwear, or neckgear element.

18. The garment of claim 16, wherein in the second folded position the garment is arranged to cover at least a lower portion of the wearer's face, at least a portion of the lower half of the wearer's face, the majority of the wearer's face, and/or at least an upper portion of the user's face.

19. The garment of claim 16, wherein the garment is configured to be reversibly sealable to at least a part of the wearer's face by the wearer configuring the sheet of fabric from the first unfolded position to the second folded position to seal the garment, and unsealing the garment by configuring the garment from the second folded position back to the first unfolded position.

20. The garment of claim 16, wherein in the second position, the garment is configured to form a seal around at least a portion of the wearer's nose, at least a portion of the bridge of the wearer's nose, at least a portion of the wearer's cheekbones, at least a portion of the wearer's cheeks, at least a portion of the wearer's jaw, at least a portion of the underside of the wearer's jaw, at least a portion of the wearer's chin, at least a portion of the underside of the wearer's chin, and/or at least a portion of the wearer's neck.

21. The garment of claim 16, wherein the garment comprises one or more filter elements configured to filter one or more hazardous substances from air to be inhaled by the wearer and/or air to be exhaled by the wearer and/or wherein the garment comprises a filter element receiving portion configured to receive one or more filter elements.

22. The garment of claim 21, wherein the garment is configured to filter a higher percentage of the air to be inhaled and/or exhaled by the wearer when the sheet is in the second folded position than in the first unfolded position.

23. The garment of claim 16, wherein the sheet is configured to permit air to flow from the outer side thereof through the filter receiving portion and/or the filter element to the inner side of the sheet and to prevent air from flowing through the other portion(s) of the sheet.

24. The garment of claim 16, wherein the sheet comprises one or more porous sections configured to permit air to flow therethrough and one or more non-porous sections configured to prevent air from flowing therethrough, wherein at least a portion of the, or each, porous section is arranged to overlay at least a portion of the filter element receiving portion and/or the filter element.

25. The garment of claim 16, wherein the releasable fastening device of the garment includes one or more magnets, press studs, snap fit connectors, hook and loop fasteners, hooks, buttons, buckles, and/or hooks.

26. The garment of claim 16, wherein the sheet of fabric comprises one or more valve devices operable between a first position, in which air is prevented from flowing from the inner side of the sheet through the valve to the outer side of the sheet and a second position, in which air is permitted to flow from the inner side of the sheet through the valve to the outer side of the sheet.

27. The garment of claim 26, wherein the valve device is a one way valve configured to prevent air from flowing from the outer side of the sheet through the valve device to the inner side of the sheet when the valve device is in the first position and when the valve device is in the second position.

28. The garment of claim 26, wherein the valve device comprises a locking member configured to engage with and lock the valve device in the first position.

* * * * *